US005655900A

United States Patent [19]

Cacciatore

[11] Patent Number: 5,655,900

[45] Date of Patent: Aug. 12, 1997

[54] GAS OVEN CONTROL SYSTEM

[75] Inventor: Joseph J. Cacciatore, Woodridge, Ill.

[73] Assignee: Harper-Wyman Company, Aurora, Ill.

[21] Appl. No.: 560,902

[22] Filed: Nov. 20, 1995

[51] Int. Cl.[6] ..... F23N 5/00

[52] U.S. Cl. ..... 431/70; 431/29

[58] Field of Search ..... 431/69, 70, 71, 431/29

[56] References Cited

U.S. PATENT DOCUMENTS

| | | | |
|---|---|---|---|
| 3,270,800 | 9/1966 | Deziel et al. | 431/69 |
| 3,384,439 | 5/1968 | Walbridge | 431/24 |
| 3,574,496 | 4/1971 | Hewitt | 431/71 |
| 3,832,123 | 8/1974 | Walbridge | 431/66 |
| 3,853,455 | 12/1974 | Riordan et al. | 431/80 |
| 3,861,854 | 1/1975 | Walbridge | 431/80 |
| 3,963,410 | 6/1976 | Baysinger | 431/46 |
| 4,019,854 | 4/1977 | Carlson et al. | 431/80 |
| 4,289,476 | 9/1981 | Visos et al. | 431/66 |
| 4,303,385 | 12/1981 | Rudich, Jr. et al. | 431/70 |
| 4,518,345 | 5/1985 | Mueller et al. | 431/29 |
| 5,085,573 | 2/1992 | Geary | 431/70 |
| 5,127,823 | 7/1992 | Bonner | 431/46 |

*Primary Examiner*—Noah P. Kamen

*Attorney, Agent, or Firm*—Mason, Kolehmainen, Rathburn & Wyss

[57] ABSTRACT

An oven control system and a method are provided for controlling for a gas oven burner. A gas valve is operatively controlled to supply gas to the gas oven burner. A spark voltage supply is operatively controlled for generating ignition sparks near the gas oven burner. A flame sensing circuit coupled to the gas oven burner provides a flame status representative signal to a control processor. The control processor operatively controls both the gas valve and the spark voltage supply.

13 Claims, 4 Drawing Sheets

GAS OVEN CONTROL SYSTEM

FIELD OF THE INVENTION

The present invention relates to a gas oven control system, and more particularly to a microprocessor based control system and method for controlling a gas oven including direct spark ignition.

DESCRIPTION OF THE PRIOR ART

Various arrangements are known in the art for controlling temperature in a gas oven. Many of the known control systems for controlling the oven temperature in a gas stove are complicated in arrangement and as a result are expensive.

Typically a hot surface element is used with a matched hot-wire valve for gas ignition. The hot surface element is formed of a temperature responsive (TR) ceramic material that is easily breakable. The hot surface element typically is always energized or ON as long as the flame is present. Continuous electrical energy is required. The hot surface element deteriorates or wears out with age. Also it is expensive to provide a matched pair of the hot surface element and the hot-wire valve.

A need exists for an improved gas oven control system. It is desirable to provide an improved gas oven control system that includes direct spark ignition; and that is less expensive and a simpler arrangement, while providing effective and reliable operation with minimal electrical energy usage.

SUMMARY OF THE INVENTION

A principal object of the present invention is provide an improved gas oven control system and method for controlling a gas oven including direct spark ignition. Other important objects of the invention are to provide an improved gas oven control system that includes direct spark ignition; to provide such improved gas oven control system that provides effective and reliable operation; to provide such improved gas oven control system that is less expensive and a simpler arrangement than known control systems; and to provide such improved gas oven control system overcoming one or more of the disadvantages of known oven control arrangements.

In brief, an oven control system and a method are provided for controlling for a gas oven burner. A gas valve is operatively controlled to supply gas to the gas oven burner. A spark voltage supply is operatively controlled for generating ignition sparks near the gas oven burner. A flame sensing circuit coupled to the gas oven burner provides a flame status representative signal to a control processor. The control processor operatively controls both the gas valve and the spark voltage supply.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
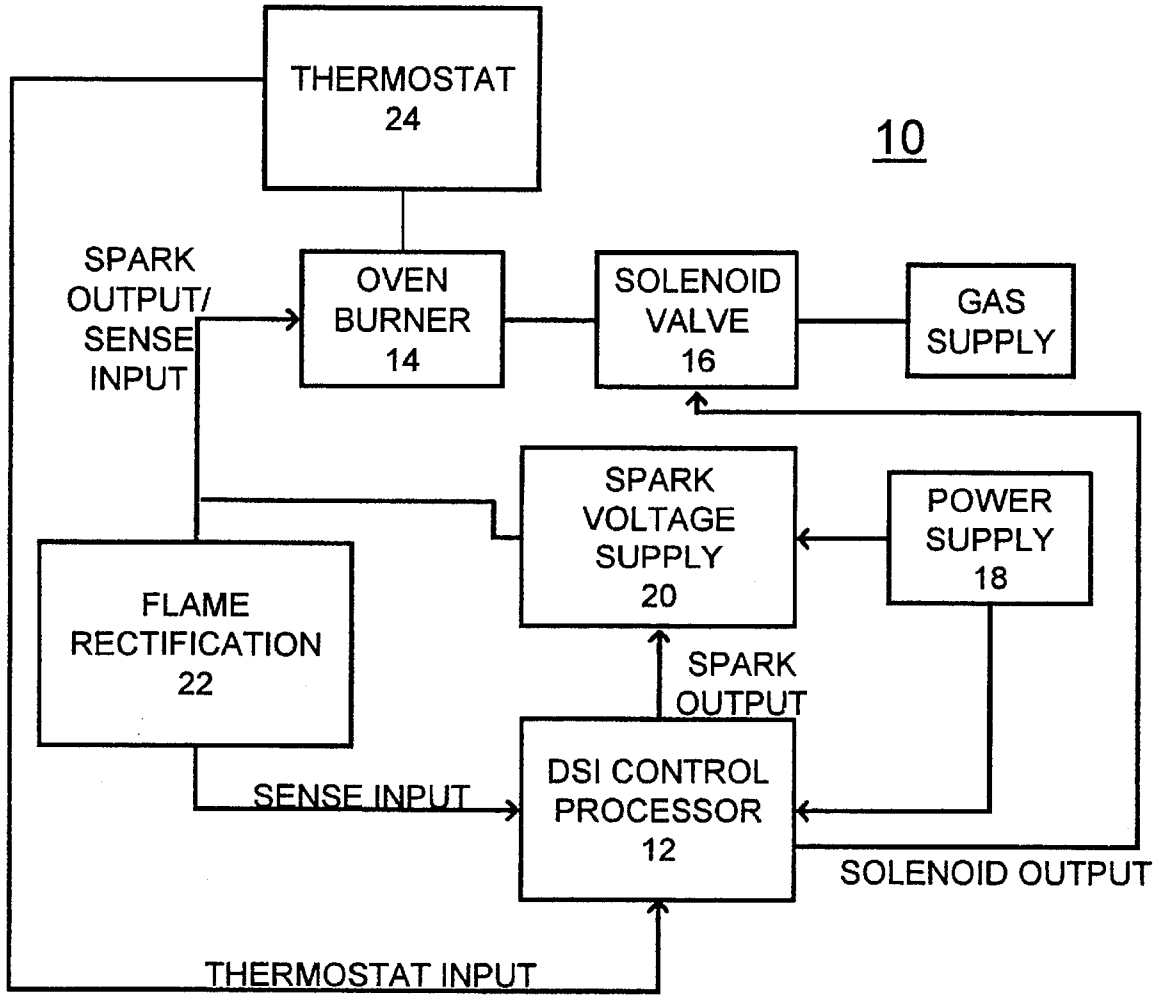
FIG. 1 is a block diagram illustrating an oven control system employing a microprocessor for implementing an oven control method in accordance with the present invention.
Figure 2A:
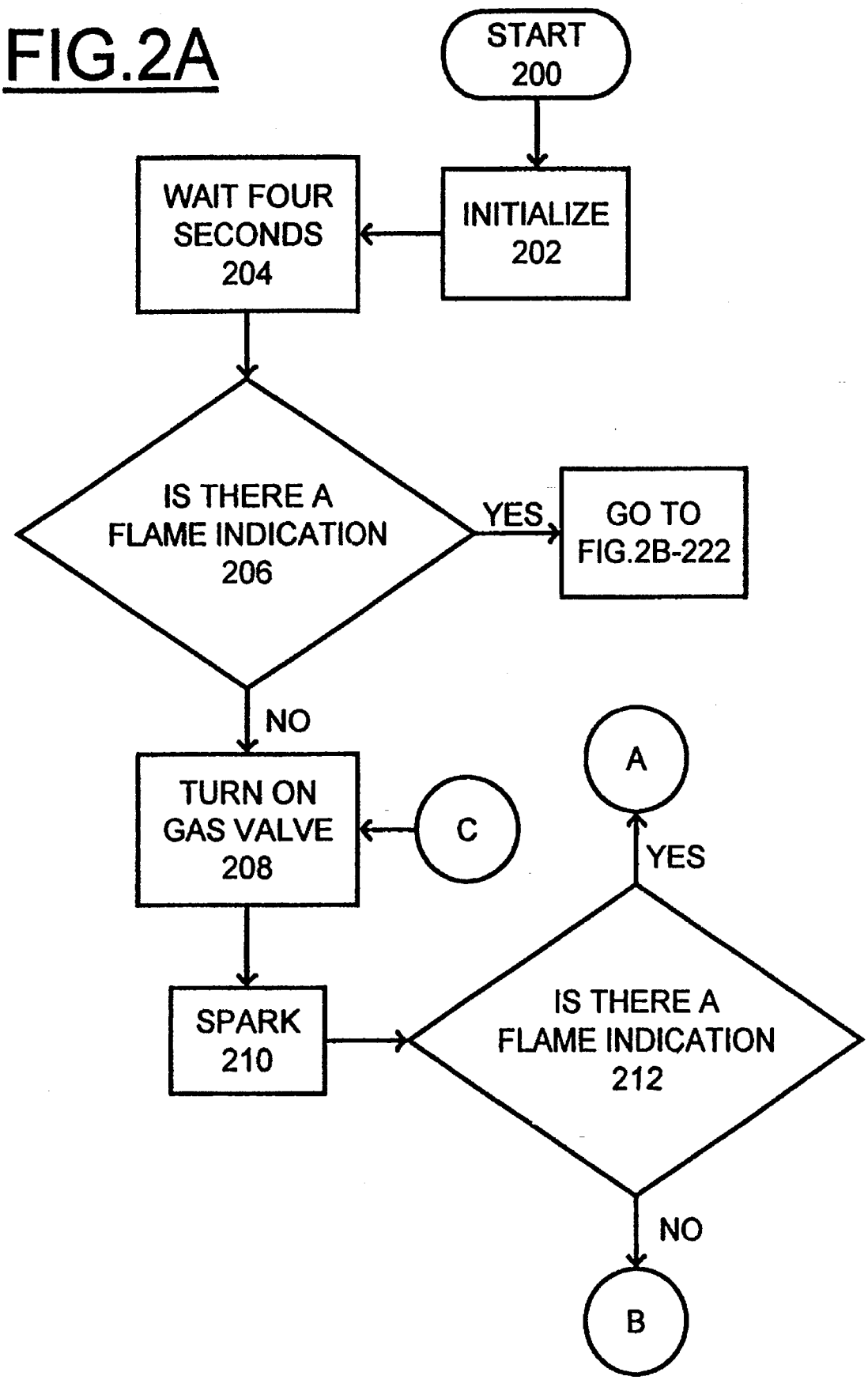
FIGS. 2A, 2B and 2C together provide a flow chart illustrating sequential steps of the oven control method in accordance with the present invention.
Figure 2B:
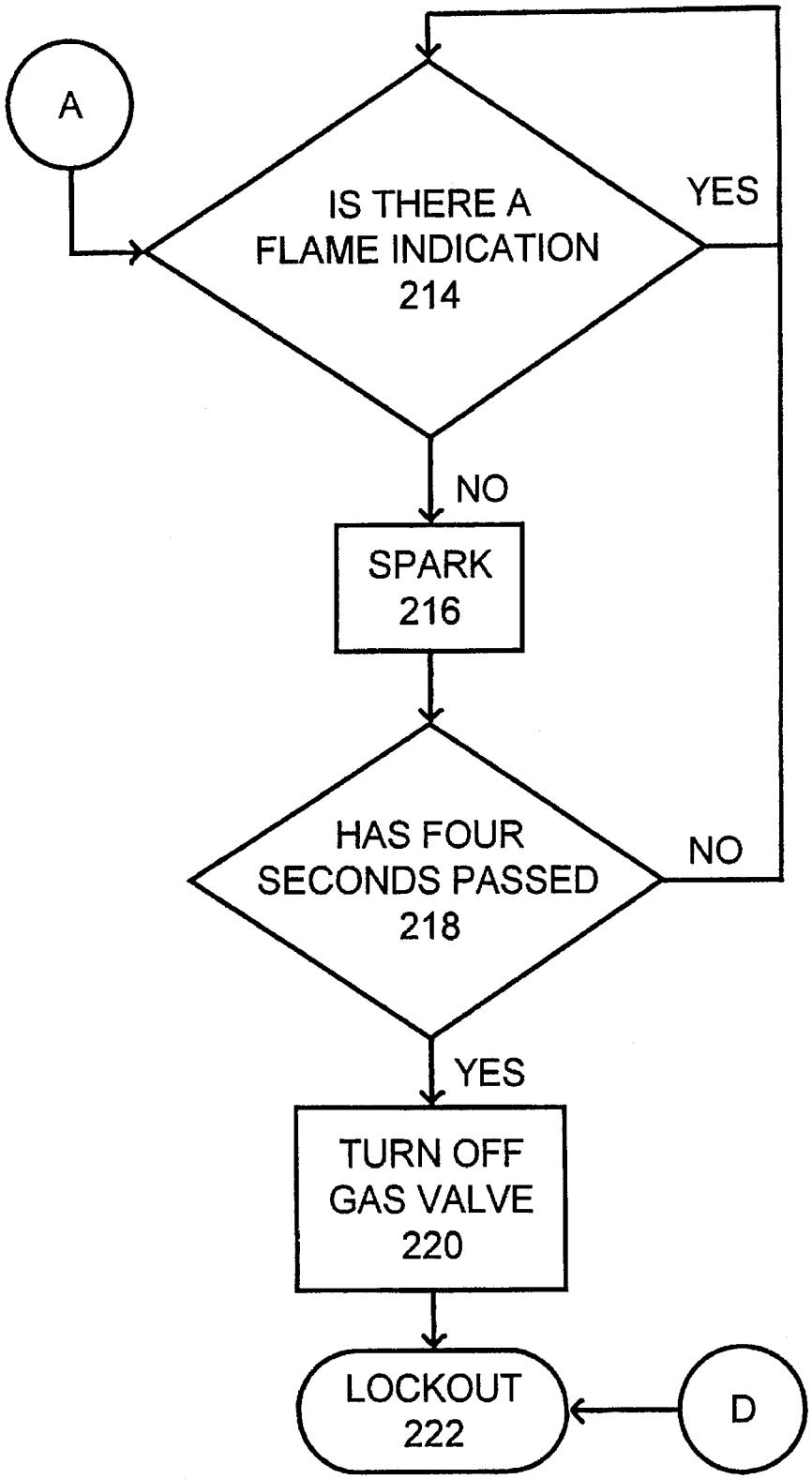
Figure 2C:
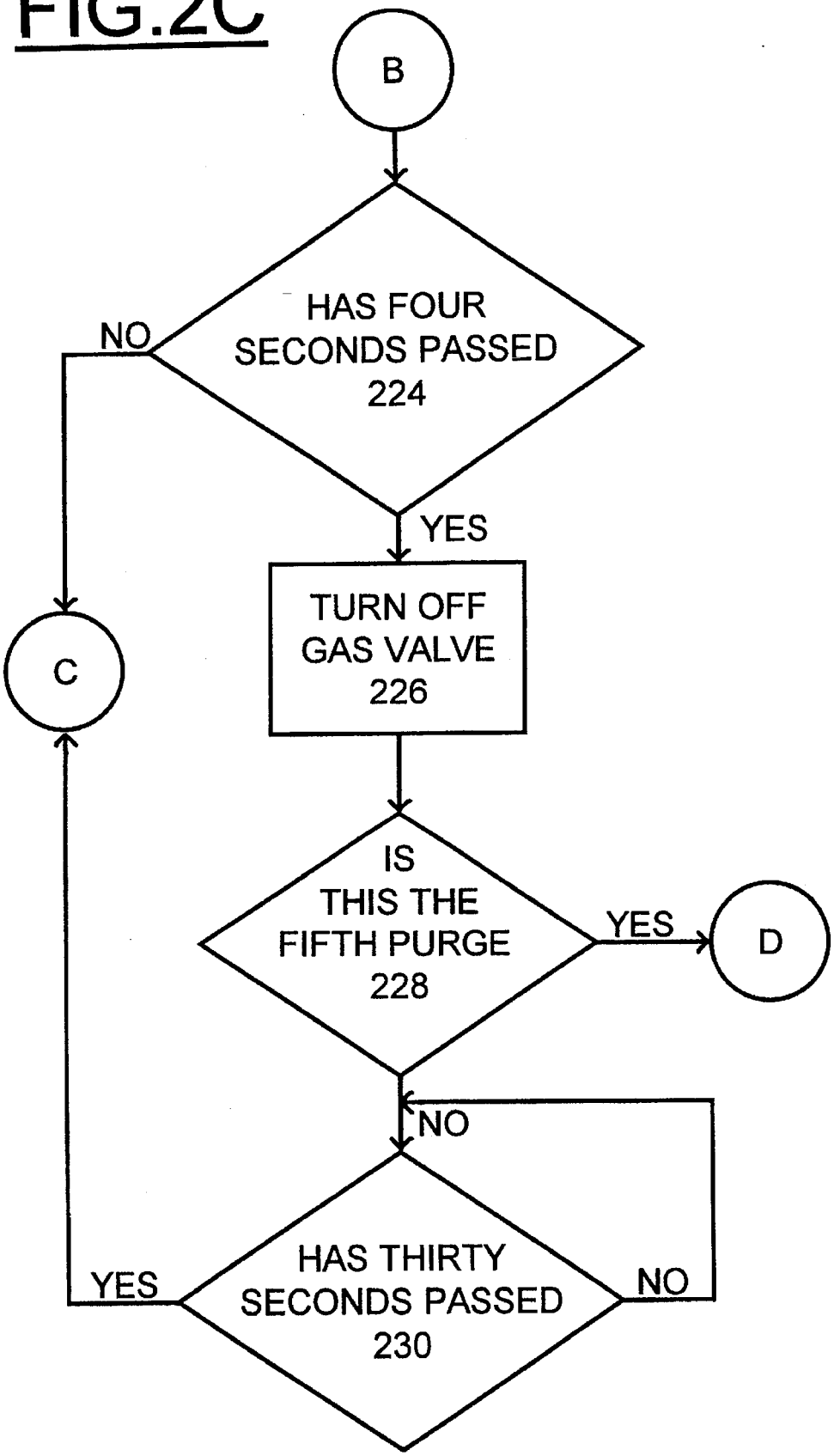

Having reference now to the drawings, in FIG. 1 there is shown an oven control system generally designated by 10 for implementing an oven control method of the invention. Oven control system 10 includes a microprocessor 12 that is suitably programmed for performing direct spark ignition control for a gas oven burner 14 including the oven control method as shown in FIGS. 2A, 2B and 2C. Oven control system 10 includes a solenoid valve 16 operatively controlled by the microprocessor 12.

Gas is supplied to the oven burner 14 by opening the solenoid valve 16. Oven control system 10 includes a power supply 18 coupled to the microprocessor 12. The power supply 18 is a low voltage supply, for example, a 5 volt supply. The low voltage output of power supply 18 is coupled to a spark voltage supply 20. The spark voltage supply 20 provides a high voltage to a conductor labeled SPARK OUTPUT/SENSE INPUT causing ignition sparks to be produced near a selected burner port (not shown) of the oven burner 14. The rate of sparking and the decision to generate sparks is controlled by the microprocessor 12. A control signal applied from the microprocessor 12 to the spark voltage supply 20 is indicated at a line labeled SPARK OUTPUT.

Oven control system 10 includes a flame rectification type of flame sensing circuit 22 applying a flame status representative signal at a line labeled SENSE INPUT to the microprocessor 12. When flame is present at the oven burner 14, the flame rectification circuit 22 provides a flame present representative signal to the microprocessor 12 for discontinuing ignition sparks. Otherwise when flame is not present at the oven burner 14, the flame rectification circuit 22 provides a flame absent representative signal to the microprocessor 12 for selectively enabling ignition sparks. Oven control system 10 includes a thermostat 24 for sensing oven temperature and providing a temperature representative signal to the microprocessor 12 at a line labeled THERMOSTAT INPUT.

Various commercially available devices can be used for the microprocessor 12, such as an 8-bit microprocessor device MC68HC05 manufactured and sold by Motorola, Inc. of Austin, Tex. Various conventional arrangements can be used for the power supply 18, spark voltage supply 20, and the flame rectification sensing circuit 22.

Referring now to FIGS. 2A, 2B and 2C, sequential steps of the oven control method in accordance with the present invention begin at a block 200 in FIG. 2A. An initialization step is performed by the microprocessor 12 to set starting program values as indicated at a block 202 labeled INITIALIZE. Then a predetermined time delay, for example four seconds is identified by the microprocessor 12 as indicated at a block 204 labeled WAIT FOUR SECONDS. Then the output signal of flame rectification circuit 18 is checked to determine whether there is a flame present at the oven burner 14 as indicated at a decision block 206 labeled IS THERE A FLAME INDICATION.

When a flame is not identified at block 206, then the solenoid valve 16 is opened to supply gas to the oven burner 14 as indicated at a block 208 labeled TURN ON GAS VALVE. Then microprocessor 12 applies a control signal to the spark voltage supply 20 for providing ignition sparking at the oven burner 14 as indicated at a block 210 labeled SPARK. Then the output signal of flame rectification circuit 18 is checked again to determine whether there is a flame present at the oven burner 14 as indicated at a decision block 212 labeled IS THERE A FLAME INDICATION. If a flame is present, then the sequential steps continue following an entry point A in FIG. 2B. Otherwise if determined at block 212 in FIG. 2A that a flame is not present, then the sequential steps continue following an entry point B in FIG. 2C.

Referring now to FIG. 2B, there are shown continuing sequential steps for monitoring the oven flame and igniting if required. Following entry point A the output signal of flame rectification circuit 18 is checked to determine whether the flame is still present at the oven burner 14 as indicated at a decision block 214 labeled IS THERE A FLAME INDICATION. When a flame is present, then monitoring of the output signal of flame rectification circuit 18 continues until no flame is detected at block 214. Then microprocessor 12 applies the ignition sparking control signal to the spark voltage supply 20 to provide ignition sparking to reignite the oven burner 14 as indicated at a block 216 labeled SPARK. Then checking to identify whether a predetermined maximum time interval has elapsed is provided as indicated at a decision block 218 labeled HAS FOUR SECONDS PASSED.

The sequential steps of checking for a flame and sparking at blocks 214 and 216 is continued for the predetermined maximum time interval, such as four seconds. When the predetermined maximum time interval has elapsed and a flame has not been identified at block 214, then the solenoid valve 16 is closed as indicated at a block 220 labeled TURN OFF GAS VALVE. Then a lockout is activated by the microprocessor 12 as indicated at a block 222. When the lockout is activated, an oven user must manually reset the thermostat 24 to restart the process at block 200 in FIG. 2A.

Referring again to FIG. 2A, when a flame present signal is identified by the microprocessor 12 at the decision block 206, then the lockout is activated by the microprocessor 12 at block 222. The oven user is required to manually reset the thermostat 24 to restart the process at block 200 in FIG. 2A. When the lockout is activated, feedback to the oven user could be provided via a display or warning light (not shown) to alert the user of possible oven system problems.

Referring now to FIG. 2C, there are shown continuing sequential steps for a purge when a flame is not detected at block 212 following ignition sparking at block 210. In FIG. 2C, following entry point B then checking whether the predetermined maximum time interval has elapsed is provided as indicated at a decision block 224 labeled HAS FOUR SECONDS PASSED. If not, then the sequential steps return to block 208 in FIG. 2A and the sequential steps are repeated. Otherwise, when determined at decision block 224 that the predetermined maximum time interval has elapsed, then the solenoid valve 16 is closed as indicated at a block 226 labeled TURN OFF GAS VALVE. Then it is determined whether a predefined number of purges has been performed as indicated at a decision block 228 labeled IS THIS THE FIFTH PURGE. When the predefined number of purges is identified at block 228, then the sequential steps go to block 222 in FIG. 2B and the lockout is activated. Otherwise, when less than the predefined number of purges is identified at block 228, then a second predetermined time interval is checked as indicated at a decision block 230 labeled HAS THIRTY SECONDS PASSED. After the second predetermined time interval has elapsed, then the sequential operations return to block 208 in FIG. 2A and the sequential steps are repeated.

While the present invention has been described with reference to the details of the embodiments of the invention shown in the drawing, these details are not intended to limit the scope of the invention as claimed in the appended claims.

What is claimed is:

1. An oven control system for a gas oven burner comprising:

gas valve means for opening and closing to supply gas to the gas oven burner;

spark voltage supply means for generating ignition sparks near the gas oven burner;

processor means for operatively controlling both said gas valve means and said spark voltage supply means;

flame sensing means coupled to the gas oven burner for applying a flame status representative signal to said processor means;

wherein said processor means includes:

means responsive to said flame sensing means applying a no flame present representative signal for operatively controlling said gas valve means for opening to supply gas to the gas oven burner; and means responsive to said flame sensing means applying a no flame present representative signal for operatively controlling said spark voltage supply means for generating ignition sparks near the gas oven burner.

2. An oven control system as recited in claim 1 wherein said processor means further includes means responsive to said flame sensing means applying a flame present representative signal for monitoring said flame sensing means until said no flame present representative signal is detected.

3. An oven control system as recited in claim 2 wherein said processor means further includes means responsive to said no flame present representative signal being detected for operatively controlling said spark voltage supply means for generating ignition sparks near the gas oven burner.

4. An oven control system as recited in claim 3 wherein said processor means further includes first timer means responsive to said flame sensing monitoring means for identifying a predetermined time interval for operatively controlling said spark voltage supply means for generating ignition sparks near the gas oven burner without detecting said flame present representative signal and means responsive to said elapsed predetermined time interval without detecting said flame present representative signal for closing said gas valve means and for activating a lockout.

5. An oven control system as recited in claim 4 wherein said processor means further includes second timer means responsive to said flame sensing means applying a no flame present representative signal for a second predetermined time interval for closing said gas valve means and for waiting for a third predetermined time interval before opening said gas valve means to purge the gas oven.

6. An oven control system as recited in claim 5 wherein said processor means further includes means for identifying a predefined number of purge sequences and means responsive to said predefined number of purge sequences for activating a lockout.

7. An oven control system as recited in claim 5 wherein said first predetermined time interval is about four seconds.

8. An oven control system as recited in claim 5 wherein said second predetermined time interval is about four seconds.

9. An oven control system as recited in claim 5 wherein said third predetermined time interval is about thirty seconds.

10. A method performed by a control processor for controlling a gas oven including direct spark ignition comprising the steps of:

opening a gas valve to supply gas to the gas oven burner;

activating a spark voltage supply for generating ignition sparks near the gas oven burner;

monitoring a flame status representative signal provided by a flame sensing circuit;

checking an elapsed time before a flame present representative signal is provided by said flame sensing circuit;

identifying said flame present representative signal before a first predetermined time interval elapses; and continuing with monitoring said flame status representative signal provided by a flame sensing circuit until said no flame present representative signal is provided;

activating a spark voltage supply for generating ignition sparks near the gas oven burner; and detecting said flame present representative signal within a second time interval and continuing with monitoring said flame status representative signal provided by a flame sensing circuit until said no flame present representative signal is provided.

11. A method performed by a control processor for controlling a gas oven as recited in claim 10 further includes the steps of identifying a second predetermined time interval without detecting said flame present representative signal and responsive to said elapsed predetermined time interval without detecting said flame present representative signal, closing said gas valve and activating a lockout, said lockout requiring a user operation to continue the control sequence.

12. A method performed by a control processor for controlling a gas oven as recited in claim 10 further includes the steps of identifying a first predetermined time interval before said flame present representative signal is provided by said flame sensing circuit; closing said gas valve and waiting for a third predetermined time interval before opening said gas valve to purge the gas oven.

13. A method performed by a control processor for controlling a gas oven as recited in claim 12 further includes the steps of identifying a predefined number of purge sequences and activating a lockout.

* * * * *